US010108130B2

(12) United States Patent
Ichikawa et al.

(10) Patent No.: US 10,108,130 B2
(45) Date of Patent: Oct. 23, 2018

(54) DEVELOPER CARTRIDGE HAVING DEVELOPER ELECTRODE

(71) Applicant: BROTHER KOGYO KABUSHIKI KAISHA, Nagoya-shi, Aichi-ken (JP)

(72) Inventors: Tomoya Ichikawa, Nagoya (JP); Takashi Shimizu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/470,395

(22) Filed: Mar. 27, 2017

(65) Prior Publication Data

US 2018/0017928 A1 Jan. 18, 2018

(30) Foreign Application Priority Data

Jul. 15, 2016 (JP) ..... 2016-140572

(51) Int. Cl.
*G03G 15/00* (2006.01)
*G03G 21/16* (2006.01)

(52) U.S. Cl.
CPC ..... *G03G 15/80* (2013.01); *G03G 21/1676* (2013.01)

(58) Field of Classification Search
CPC ..... G03G 15/80; G03G 21/1652; G03G 21/1676; G03G 21/1867; G03G 2221/166
See application file for complete search history.

(56) References Cited

U.S. PATENT DOCUMENTS

2015/0125175 A1* 5/2015 Fujii ..... G03G 21/1652 399/90
2015/0192878 A1 7/2015 Iriyama

FOREIGN PATENT DOCUMENTS

JP 2015-146016 8/2015

* cited by examiner

*Primary Examiner* — Hoang Ngo
(74) *Attorney, Agent, or Firm* — Merchant & Gould P.C.

(57) ABSTRACT

A developer cartridge attachable to a drum cartridge including a photosensitive drum is provided. The developer cartridge includes a casing configured to store toner therein, a developer roller rotatable about a first axis extending in an axial direction, and a developer electrode electrically connectable with the developer roller. The developer electrode is configured to be in contact with a first electrode of an image forming apparatus along the axial direction. In a state where the developer cartridge is attached to the drum cartridge, a portion of the developer electrode faces a surface of a lateral wall of the drum cartridge on an opposite side to a surface facing the casing.

19 Claims, 6 Drawing Sheets

DEVELOPER CARTRIDGE HAVING DEVELOPER ELECTRODE

CROSS REFERENCE TO RELATED APPLICATION

This application claims priority from Japanese Patent Application No. 2016-140572, filed on Jul. 15, 2016, the entire subject matter of which is incorporated herein by reference.

BACKGROUND

Technical Field

An aspect of the present disclosure is related to a developer cartridge attachable to a drum cartridge with a photosensitive drum.

Related Art

A developer cartridge, including a developer roller and a developer electrode to be electrically connectable with the developer roller, for an image forming apparatus is known. The developer electrode in the developer cartridge may have a contact surface that may contact an electrode inside a body of the image forming apparatus.

The developer cartridge may be attached to a drum cartridge in order to be installed in the body of the image forming apparatus, and in a state where the developer cartridge is attached to the drum cartridge, the contact surface of the developer electrode may be arranged outside a lateral wall of the drum cartridge. In this regard, a portion of the electrode that provides the contact surface may be arranged in an upper position with respect to the lateral wall and extend inward from the outside of the lateral wall.

SUMMARY

Meanwhile, if the drum cartridge is designed to have a higher lateral wall, the lateral wall may collide with the developer electrode in a case where the developer cartridge is attached to the drum cartridge. In order to avoid the collision, the developer electrode may be designed to be smaller; however, when the developer electrode is smaller, contact between the developer electrode and the electrode in the body of the image forming apparatus may not be secured.

The present disclosure is advantageous in that a developer cartridge, in which contact between an electrode in a developer cartridge and an electrode in a body of an image forming apparatus may be preferably maintained, is provided.

According to an aspect of the present disclosure, a developer cartridge attachable to a drum cartridge including a photosensitive drum is provided. The developer cartridge includes a casing configured to store toner therein, a developer roller rotatable about a first axis extending in an axial direction, and a developer electrode electrically connectable with the developer roller. The developer electrode is configured to be in contact with a first electrode of an image forming apparatus along the axial direction. In a state where the developer cartridge is attached to the drum cartridge, a portion of the developer electrode faces a surface of a lateral wall of the drum cartridge at an opposite side to a surface facing the casing.

According to another aspect of the present disclosure, a developer cartridge attachable to a drum cartridge having a photosensitive drum is provided. The developer cartridge includes a casing configured to store toner therein, a developer roller rotatable about an axis extending in an axial direction, and a developer electrode electrically connectable with the developer roller. The developer electrode is configured to be in contact with a first electrode of an image forming apparatus along the axial direction. The developer electrode includes a recess, in which a lateral wall of the drum cartridge is placed, in a state where the developer cartridge is attached to the drum cartridge.

BRIEF DESCRIPTION OF THE ACCOMPANYING DRAWINGS

DETAILED DESCRIPTION

Hereinafter, a process cartridge 1 according to an embodiment of the present disclosure will be described with reference to the accompanying drawings.

Figure 1:
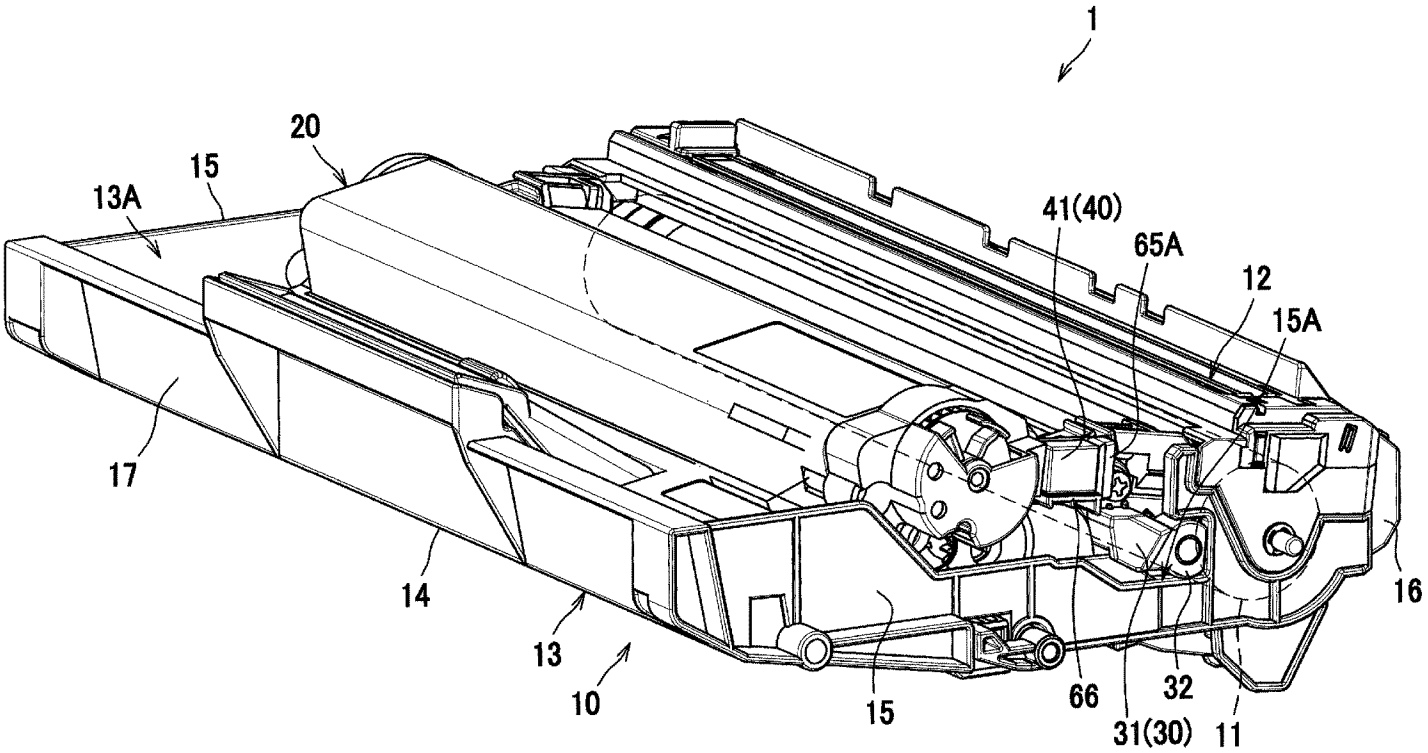
FIG. 1 is a perspective view of a process cartridge including a developer cartridge according to an embodiment of the present disclosure.

As shown in FIG. 1, the process cartridge 1 includes a drum cartridge 10 and a developer cartridge 20.

The drum cartridge 10 is attachable to and detachable from a body of an image forming apparatus, which is not shown. The drum cartridge 10 includes a photosensitive drum 11, a charger 12 to electrically charge the photosensitive drum 11, and a drum frame 13 to support the photosensitive drum 11 and the charger 12.

The drum frame 13 includes a housing 13A, which is configured to accommodate the developer cartridge 20 therein. The drum frame 13 may include a bottom wall 14, two (2) lateral walls 15, a first connecting wall 16, and a second connecting wall 17. The bottom wall 14 may be in an approximately rectangular shape and form a bottom of the housing 13A. The lateral walls 15 may extend in one direction from the bottom wall at ends of the bottom wall 14 with regard to an axial direction of the photosensitive drum 11. Each of the first connecting wall 16 and the second connecting wall 17 connects the lateral walls 15 and the bottom wall 14 with one another.

The lateral walls 15 flank the photosensitive drum 11 along the axial direction and support the photosensitive drum 11. Each of the lateral walls 15 includes a guiding face 15A to guide the developer cartridge 20, or a cover 32 which will be described later, toward the photosensitive drum 11.

Figure 6A:
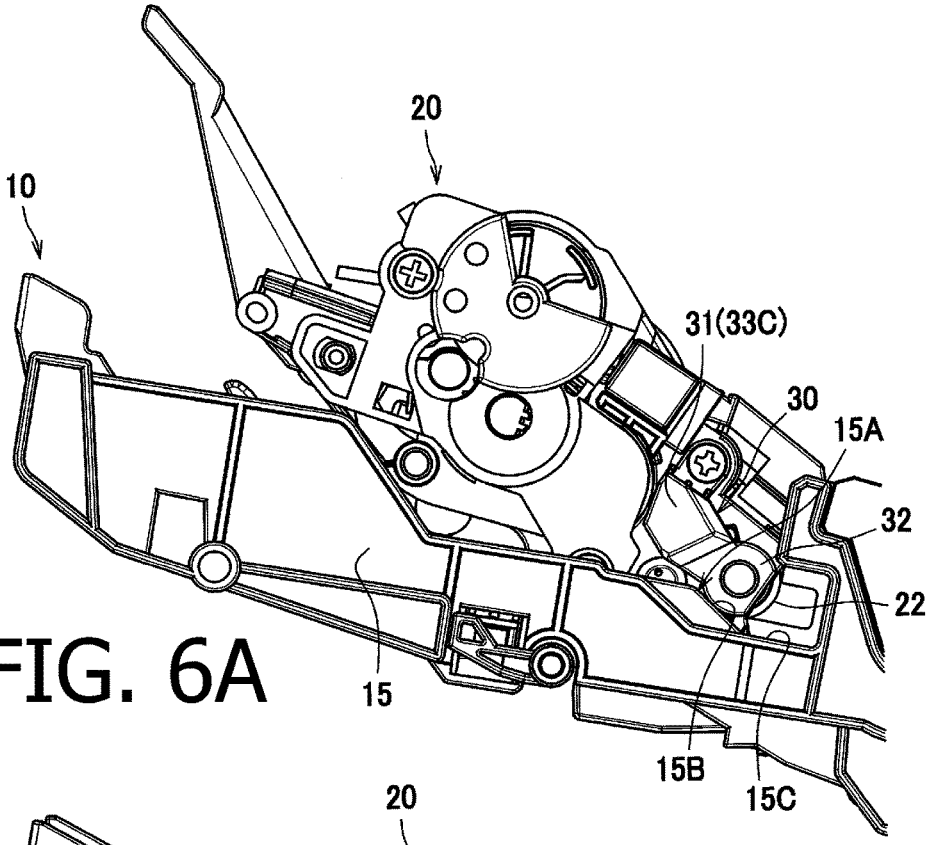
FIGS. 6A-6B are cross-sectional views of the developer cartridge being attached to the drum cartridge according to the embodiment of the present disclosure.

The guiding face 15A forms an edge of the lateral wall 15. The guiding face 15A is formed to have steps in different heights, which are lowered to be closer to the bottom wall 14 as the guiding face 15A approaches the photosensitive drum 11. Specifically, as shown in FIG. 6A, the guiding face 15A includes a first guiding face 15B and a second guiding face 15C. The first guiding face 15B inclines to be closer to the bottom wall 14 as the first guiding face 15B extends closer to the photosensitive drum 11. The second guiding face 15C is continuous with an end of the first guiding face 15B closer to the photosensitive drum 11 and extends along the bottom wall 14.

Figure 2:
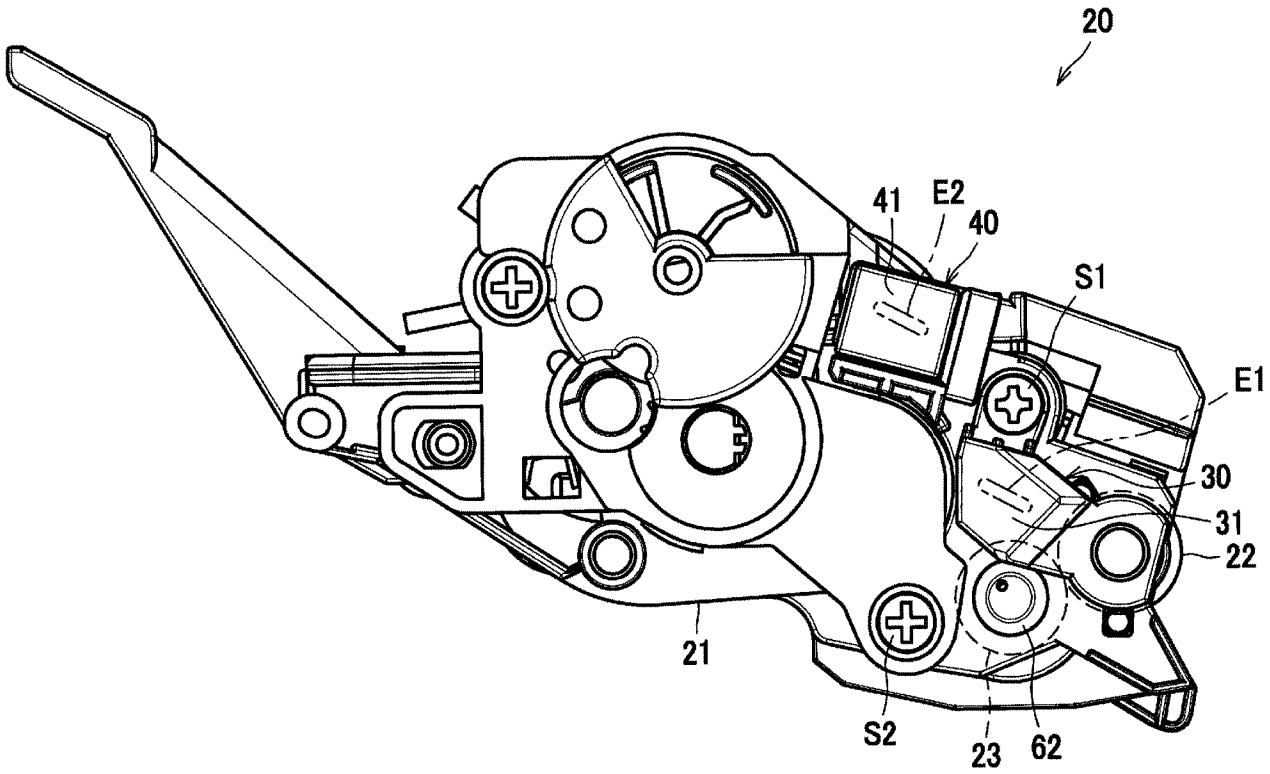
FIG. 2 is a side view of the developer cartridge according to the embodiment of the present disclosure.

The developer cartridge 20 is attachable to and detachable from the drum cartridge 10. As shown in FIG. 2, the developer cartridge 20 includes a casing 21, a developer roller 22, a supplier roller 23, a developer electrode 30, and a supplier electrode 40. The casing 21 may store toner therein. The developer roller 22 and the supplier roller 23 extend in the axial direction. The developer electrode 30 and the supplier electrode 40 are electrically connected with the developer roller 22 and the supplier roller 23, respectively.

The developer roller 22 is configured to supply the toner to an electrostatic image, which is formed on the photosensitive drum 11. The supplier roller 23 may supply the toner to the developer roller 22.

The developer electrode 30 includes a first contact section 31, which may contact a first electrode E1 in the image forming apparatus along the axial direction. The first electrode E1 includes a spring (not shown), which may expand or contract in the axial direction. The first electrode E1 may be urged against the first contact section 31 by an expanding force of the spring.

The supplier electrode 40 includes a second contact section 41, which may contact a second electrode E2 in the body of the image forming apparatus along the axial direction. The second electrode E2 includes a spring (not shown), which may expand or contract in the axial direction. The second electrode E2 may be urged against the second contact section 41 by an expanding force of the spring.

Figure 3:
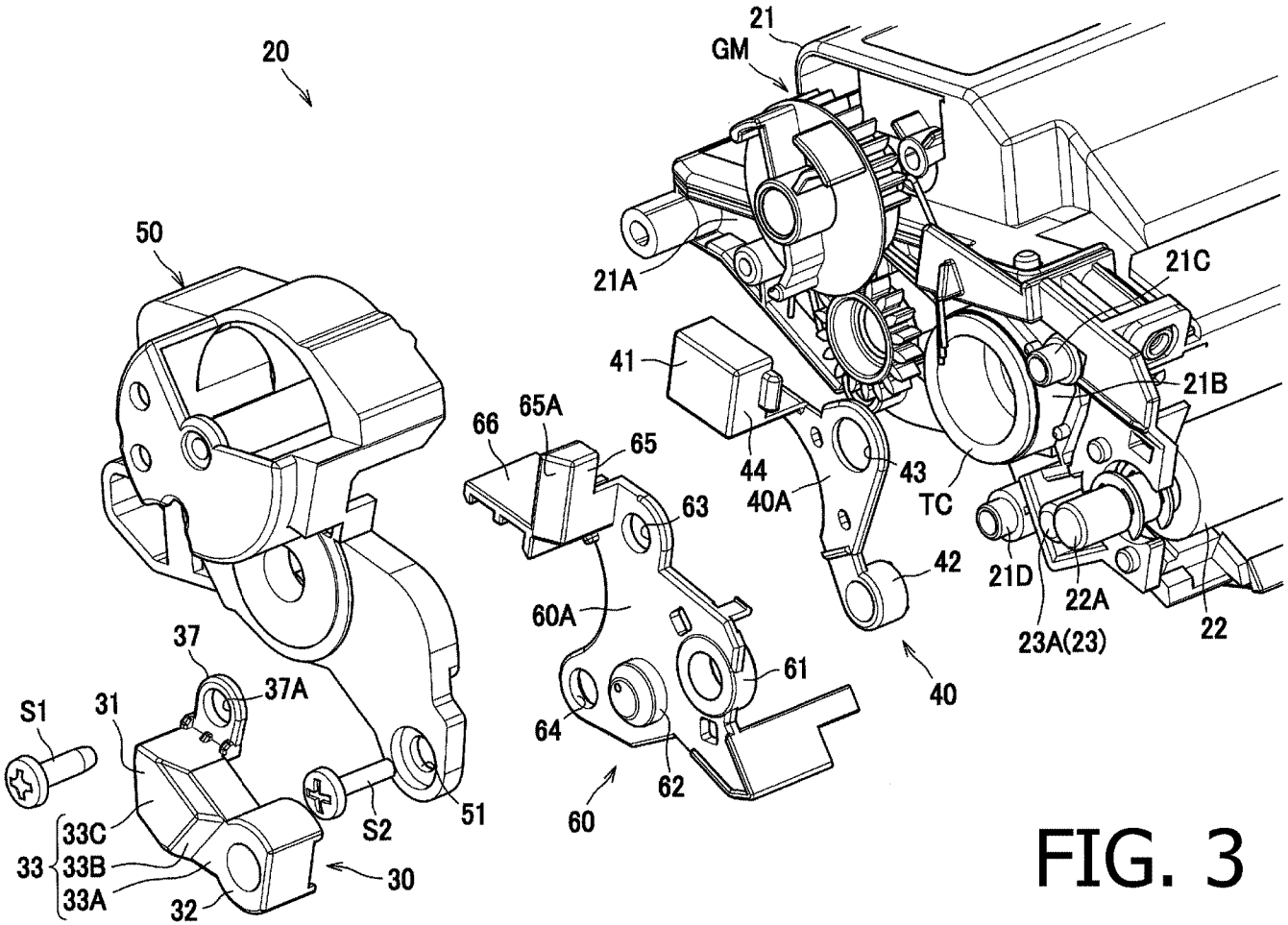
FIG. 3 is an exploded view of a sideward part of the developer cartridge according to the embodiment of the present disclosure.

As shown in FIG. 3, the developer cartridge 20 further includes a toner cap TC, a cover 50 to cover the toner cap TC, and a bearing 60 to support a rotation shaft 22A of the developer roller 22 rotatably and a rotation shaft 23A of the supplier roller 23.

The casing 21 include lateral walls 21A. One of the lateral walls 21A at one side along the axial direction includes a cylindrical section 21B having a toner supplier hole, through which the toner may be filled in the casing 21. The lateral wall 21A includes a first boss 21C and a second boss 21D, each of which have a cylindrical form. A first screw S1 to fasten the developer electrode 30 to the casing 21 may be screwed into the first boss 21C. A second screw S2 to fasten the cover 50 to the casing 21 may be screwed into the second boss 21D.

The first boss 21C is arranged at an opposite side to the second boss 21D across a hypothetical line that extends through a center of the cylindrical section 21B and a rotation center of the developer roller 22. In the meantime, a gear system GM to drive devices inside the casing 21, e.g., an agitator (not shown), is arranged on the lateral wall 21A at an opposite side of the cylindrical section 21B to the developer roller 22.

The toner cap TC is arranged to fit with the cylindrical section 21B to close the toner supplier hole. The toner cap TC is arranged between the gear system GM and the developer roller 22.

The cover 50 is arranged to enclose the gear system GM and the toner cap TC. The cover 50 includes a fastening hole 51, through which the second screw S2 may be inserted. The fastening hole 51 is formed at a position on an end of the cover 50 closer to the developer roller 22.

The bearing 60 includes a base 60A, a first supporting part 61, a second supporting part 62, a first hole 63, a second hole 64, a guide part 65, and a protector part 66. The base 60A is in a shape of a plate spreading orthogonally to the axial direction. The base 60A is located between the cover 50 and the casing 21 with regard to the axial direction.

The first supporting part 61 has a tubular form protruding inward from the base 62A along the axial direction. The first supporting part 61 may support the rotation shaft 22A of the developer roller 22 on an inner circumference thereof.

The second supporting part 62 includes a tubular section that protrudes outward from the base 60A along the axial direction and a round section that covers a circular and outward end of the tubular section. The second supporting part 62 may support the rotation shaft 23A of the supplier roller 23 on an inner circumference thereof.

The second hole 64 is a circular through-hole, through which the second screw S2 may be inserted. The second hole 64 is formed at a position to coincide with the second boss 21D along the axial direction. Specifically, the second hole 64 is formed at a position on an opposite side of the second supporting part 62 to the first supporting part 61. In other words, the second supporting part 62 is located on a hypothetical line that extends through a center of the second hole 64 and a center of the first supporting part 61.

The first hole 63 is a circular through-hole, through which the first screw S1 may be inserted. The first hole 63 is formed at a position to coincide with the first boss 21C along the axial direction. Specifically, the first hole 63 is located farther than the second hole 64 from the first supporting part 62.

The guide part 65 protrudes outward along the axial direction from the base 60A. An end surface of the guide part 65 forms a second incline section 65A, which may adjoin the second contact section 41 of the supplier electrode 40 when the bearing 60 and the supplier electrode 40 are assembled together. The second incline section 65A inclines with respect to the axial direction to be separated farther from the casing 21, e.g., outward, as the second incline section 65A extends closer to the second contact section 41. An outer edge of the second incline section 65A with regard to the axial direction is located farther outward with regard to the axial direction than the second contact section 41 (see FIG. 1).

Specifically, the second incline section 65A adjoins the second contact section 41 at a downstream position with regard to an attaching direction. The attaching direction is a direction, in which the process cartridge 1 is moved to be attached to the body of the image forming apparatus. The second incline section 65A inclines to be farther apart from the casing 21 as the second incline section 65A extends upstream against the attaching direction.

The protector part 66 is arranged to adjoin the second contact section 41 to extend along the second contact section 41. Specifically, the protector part 66 extends from one end of the second incline section 65A in a direction to be farther away from the developer roller 22. An edge of the protector part 66 at an outer side with regard to the axial direction is located farther outward with regard to the axial direction than the second contact section 41 (see FIG. 1).

The casing 21, the cover 50, and the bearing 60 may be made of non-conductive resin. Meanwhile, the developer electrode 30 and the supplier electrode 40 may be made of conductive resin.

The supplier electrode 40 includes a base 40A, a roller contact part 42, a receptive hole 43, and a protrusive part 44. The base 40A has a shape of a plate spreading orthogonally to the axial direction and is located between the bearing 60 and the casing 21 with regard to the axial direction.

The roller contact part 42 has a tubular form protruding inward along the axial direction from the base 40A. The roller contact part 42 is arranged to contact the rotation shaft 23A of the supplier roller 23 at an inner circumference thereof.

The receptive hole 43 is a hole, in which the first boss 21C of the casing 21 may loosely fit. A diameter of the receptive hole 43 is larger than an outer diameter of the first boss 21C.

The protrusive part 44 protrudes outward along the axial direction from the base 40A. An end of the protrusive part 44 forms the second contact section 41. The second contact section 41 may be in a form of a rectangular plate. The second contact section 41 includes a surface, which spreads orthogonally to the axial direction and may contact the second electrode E2 (see FIG. 2). In other words, the second contact section 41 includes a surface that may contact the second electrode E2 when the developer cartridge 20 is attached to the body of the image forming apparatus.

The second contact section 41 is located at a position displaced from the rotation shaft 23A of the supplier roller 23. Specifically, the second contact section 41 is located on an opposite side of the receptive hole 43 to the roller contact part 42.

The developer electrode 30 includes a cover part 32 and a plate part 33 extending from the cover part 32 in a radial direction of the rotation shaft 22A of the developer roller 22. The cover part 32 has an approximate shape of a cylinder, which may cover a circumference of the rotation shaft 22A of the developer roller 22. In particular, the cover part 32 has a shape of a cylinder, a portion of an outer circumference of which is omitted. The cover part 32 contacts the rotation shaft 22A of the developer roller 22 at an inner circumference thereof. The cover part 32 is arranged to adjoin outward the first supporting part 61 of the bearing 60 along the axial direction.

The plate part 33 includes a first plate section 33A, a second plate section 33C, and a first incline section 33B. The first plate section 33A extends from the cover part 32. The second plate section 33C includes a first contact section 31. The first incline section 33B connects the first plate section 33A with the second plate section 33C. The first incline section 33B inclines to be farther apart from the casing 21 as the second incline section 33B extends farther from the cover part 32, or the rotation shaft 22A, in the radial direction.

In particular, the first incline section 33B adjoins the second plate section 33C, i.e., the first contact section 31, at a downstream position with regard to the attaching direction to attach the process cartridge 1 to the body of the image forming apparatus. The first incline section 33B inclines to be farther apart from the casing 21 as the first incline section 33B extends upstream against the attaching direction.

An outer surface of the second plate section 33C with regard to the axial direction forms the first contact section 31. The first contact section 31 includes a surface, which spreads orthogonally to the axial direction and may contact the first electrode E1 (see FIG. 2). In other words, the first contact section 31 includes a surface that may contact the first electrode E1 when the developer cartridge 20 is attached to the body of the image forming apparatus.

Figure 4:
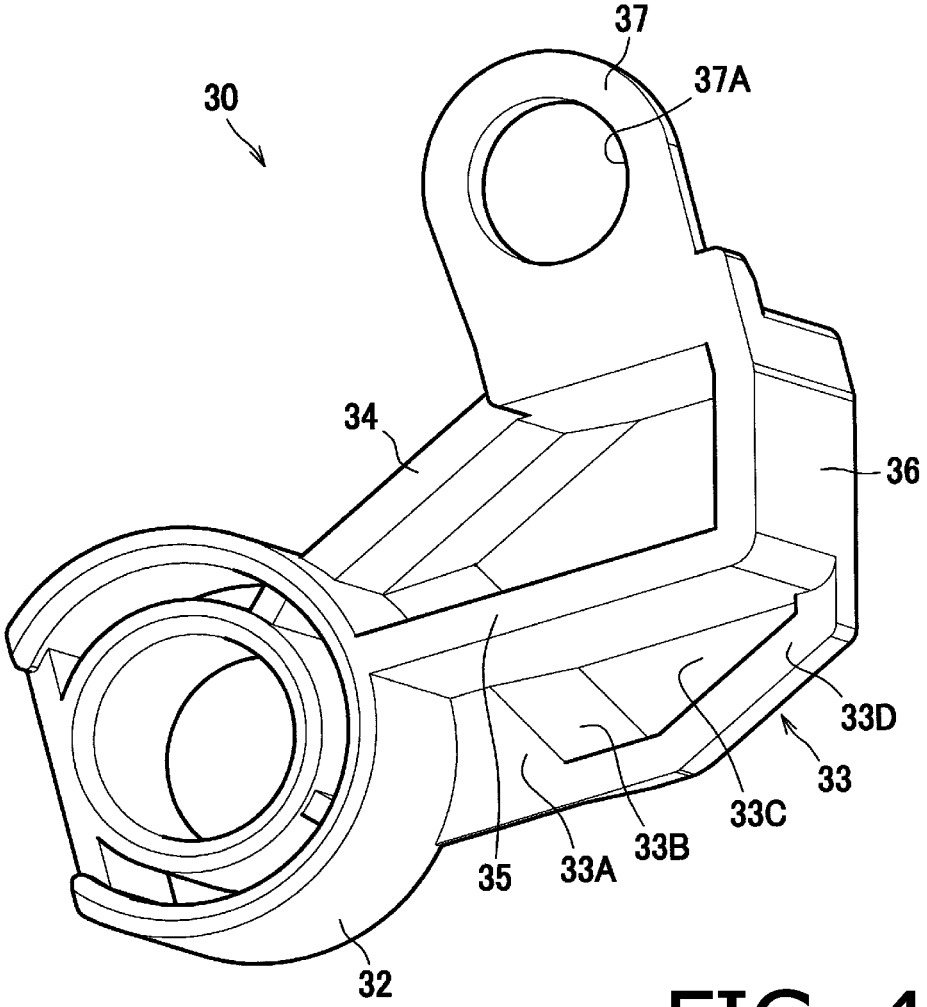
FIG. 4 is a perspective view of a developer electrode according to the embodiment of the present disclosure in an outward view along an axial direction.

As shown in FIG. 4, the developer electrode 30 further includes a first protrusive section 34, a second protrusive section 35, a connector section 36, and a fastening section 37, which are formed in shapes of plates, on an inner side of the plate part 33 with regard to the axial direction. The first protrusive section 34 extends radially outward from the cover part 32 in the radial direction.

The second protrusive section 35 extends radially outward from the cover part 32 in the radial direction. The second protrusive section 35 is spaced apart from the first protrusive section 34 along a circumferential direction of the cover part 32.

The connector section 36 connects the first protrusive section 34 with the second protrusive section 35 at ends of the first protrusive section 34 and the second protrusive section 35, which are on an opposite side to the cover part 32.

The fastening section 37 protrudes from the first protrusive section 34 in a direction to be farther from the second protrusive section 35. The fastening section 37 is located at an inward edge of the first protrusive section 34, i.e., an edge closer to the casing 21, with regard to the axial direction at a position spaced apart from the cover part 32. The fastening section 37 includes a hole 37A, through which the first screw S1 (see FIG. 3) may be inserted.

The plate part 33 connects the first protrusive section 34, the second protrusive section 35, and the connector section 36 with one another at outer ends thereof, i.e., ends at an opposite side to the casing 21, with regard to the axial direction. The plate part 33 protrudes from the second protrusive section 35 in a direction to be farther from the first protrusive section 34. In other words, ends of the first plate section 33A, the first incline section 33B, and the second plate section 33C at the opposite side to the first protrusive section 34 are located farther than the second protrusive section 35 from the first protrusive section 34.

Further, at the ends of the first incline section 33B and the second plate section 33C opposite to the first protrusive section 34, formed is an enhancing rib 33D, which protrudes inward along the axial direction from the first incline section 33B and the second plate section 33C. An inward surface of the enhancing rib 33D with regard to the axial direction is continuous with an inward surface of the first plate section 33A with regard to the axial direction to spread on a same plane.

As shown in FIG. 2, the first contact section 31 is located between the first screw S1 and the second supporting part 62 with regard to a direction pointing from the first screw S1 toward the second supporting part 62. In other words, along a direction pointing from the first hole 63 (see FIG. 3), in which the first screw S1 is inserted, toward the second supporting part 62, the first contact section 31 is located between the first hole 63 and the second supporting part 62.

Further, the first contact section 31 is located between the first screw S1 and the second screw S2 with regard to a direction pointing from the first screw S1 toward the second screw S2. In other words, along a direction pointing from the first hole 63 (see FIG. 3), in which the first screw S1 is inserted, toward the second hole 64, in which the second screw S2 is inserted, the first contact section 31 is located between the first hole 63 and the second hole 64.

Figure 5:
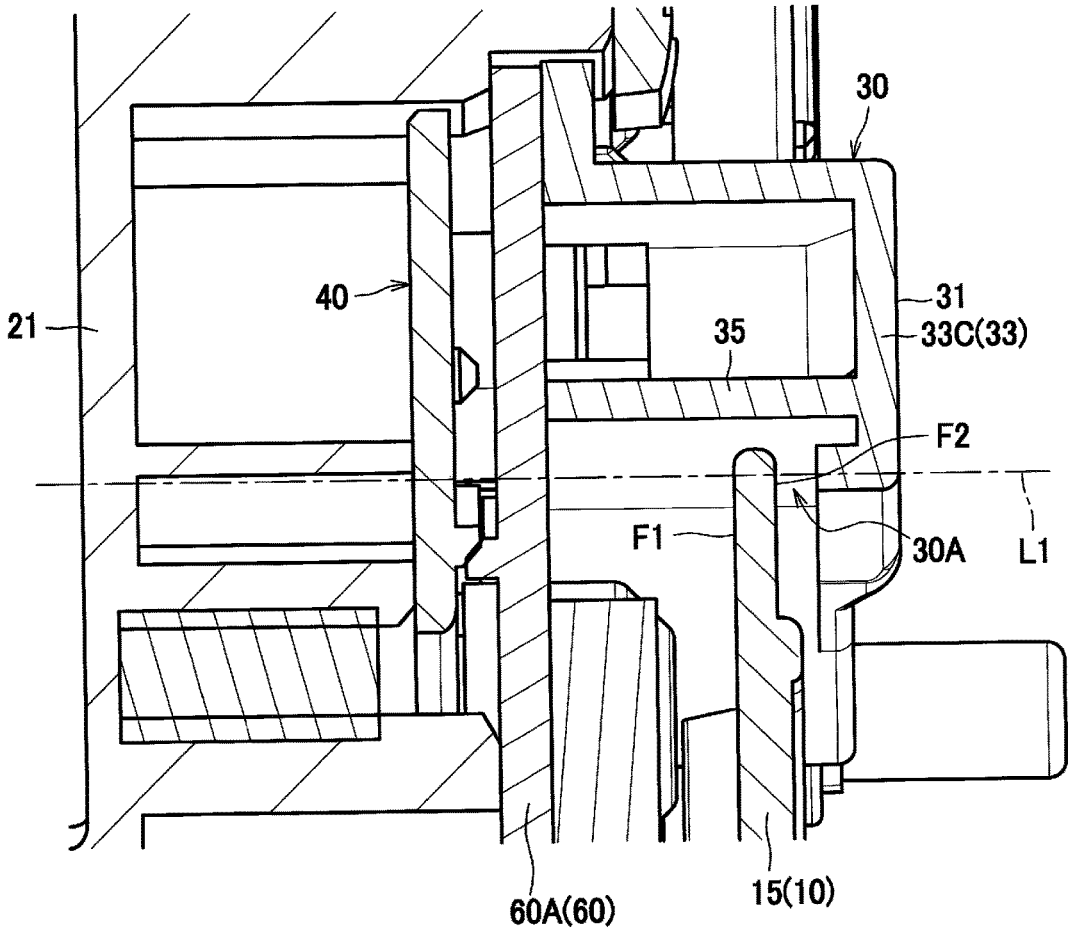
FIG. 5 is a cross-sectional view of the process cartridge according to the embodiment of the present disclosure at a section spreading across a first supporting part and a lateral wall.

As shown in FIG. 5, the first contact section 31 is located at a position on an opposite side of the lateral wall 15 of the drum cartridge 10 to the base 60A and the casing 21 in a case where the developer cartridge 20 is attached to the drum cartridge 10. In particular, the first contact section 31, the lateral wall 15, the base 60A, and the casing 21 coincide with one another along the axial direction so that a line L1 in parallel with the axial direction extends through the first contact section 31, the lateral wall 15, the base 60A, and the casing 21. In other words, the first contact section 31, the lateral wall 15, the base 60A, and the casing 21 align at least partly on the line L1 along the axial direction.

Therefore, the second plate section 33C being a portion of the developer electrode 30 may face a surface F2 of the lateral wall 15 of the drum cartridge 10, which is at an opposite side to a surface F1 of the lateral wall 15 that faces the casing 21, in a case where the developer cartridge 20 is attached to the drum cartridge 10. In other words, the second plate section 33C may face the surface F2, which is at the outer side or the opposite side to the surface F1 being closer to the casing 21, in a case where the developer cartridge 20 is attached to the drum cartridge 10.

In this regard, in a case where the developer cartridge 20 is attached to the drum cartridge 10, the developer electrode 30 includes a recess 30A, where the lateral wall 15 of the drum cartridge 10 may be placed. The recess 30A is formed by the second plate section 33C and the second protrusive section 35. In this regard, the recess 30A is open toward the base 60A of the bearing 60 and toward the lateral wall 15, and the lateral wall 15 may enter the recess 30A through the opening.

Meanwhile, the second plate section 33C is, in a case where the developer cartridge 20 is attached to the drum cartridge 10, spaced apart from the lateral wall 15 of the drum cartridge 10 along the axial direction.

With regard to the developer cartridge 20 configured as above, next, below will be described a sequence of actions to attach the developer cartridge 20 to the drum cartridge 10.

As shown in FIG. 6A, a user may place the cover part 32 of the developer cartridge 20 on the guiding face 15A of the lateral wall 15 of the drum cartridge 10. The user may move the cover part 32 to slide on the first guiding face 15B and on the second guiding face 15C to move the developer cartridge 20 closer to the photosensitive drum 11 (see FIG. 1).

Figure 6B:
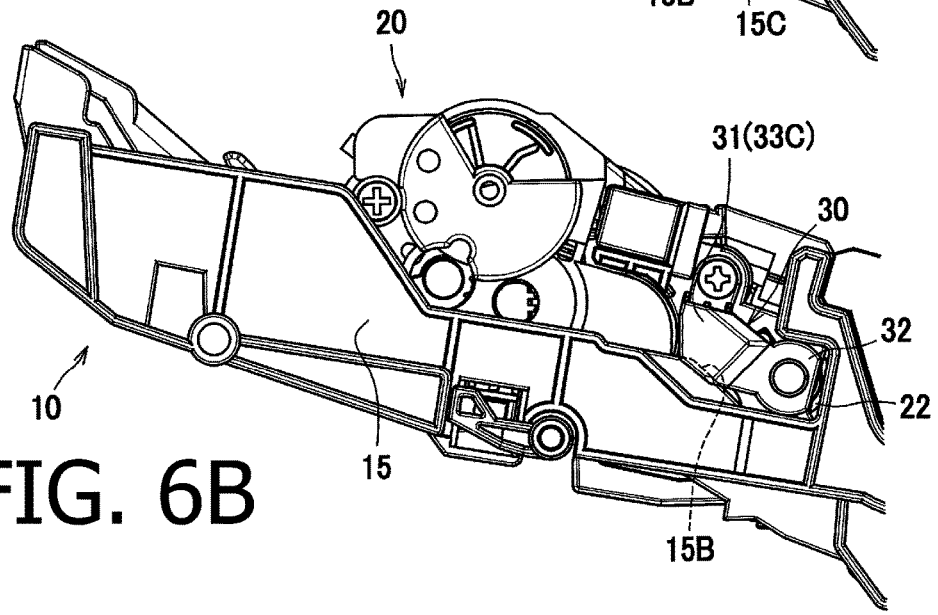

In a case where the developer roller 22 contacts the photosensitive drum 11, the user may pivot the developer cartridge 20 about the cover part 32 so that the developer cartridge 20 may be attached to the drum cartridge 10, as shown in FIG. 6B. Meanwhile, a portion of the lateral wall 15, which includes the first guiding face 15B, enters the recess 30A in the developer electrode 30 (see FIG. 5). Thereby, the portion of the developer electrode 30, i.e., the second plate section 33C that includes the first contact section 31, may face the portion of the lateral wall 15 along the axial direction, and simultaneously, may be located at the outer side of the portion of the lateral wall 15 with regard to the axial direction.

According to the configuration of the developer cartridge 20 described above, in a case where the developer cartridge 20 is attached to the drum cartridge 10, the first contact section 31 is located at the opposite side of the lateral wall 15 of the drum cartridge 10 to the casing 21, i.e., at the side opposite to the casing 21 across from the lateral wall 15; therefore, a size of the first contact section 31 may be increased, and the first contact section 31 may be placed to contact the first electrode E1 stably.

According to the configuration of the developer cartridge 20 described above, the first incline section 33B is formed at the downstream position from the first contact section 31 with regard to the attaching direction. Therefore, in a case where the process cartridge 1 is being attached to the body of the image forming apparatus, the first incline section 33B may guide the first electrode E1 to the first contact section 31 smoothly.

According to the configuration of the developer cartridge 20 described above, in a case where the developer cartridge 20 is attached to the drum cartridge 10, the second plate section 33C may be spaced apart from the lateral wall 15 of the drum cartridge 10 along the axial direction. Therefore, in a case where the developer cartridge 20 is being attached to the drum cartridge 10, the second plate section 33C may be prevented from colliding with the lateral wall 15 of the drum cartridge 10.

According to the configuration of the developer cartridge 20 described above, the second incline section 65A is formed on the downstream position from the second contact section 41 with regard to the attaching direction. Therefore, when the process cartridge 1 is being attached to the body of the image forming apparatus, the second incline section 65A may guide the second electrode E2 to the second contact section 41 smoothly.

According to the configuration of the developer cartridge 20 described above, the bearing 60 includes the protector part 66, which adjoins the second contact section 41 to extend along the second contact section 41. Therefore, the second contact section 41 may be protected by the protector part 66 securely.

According to the configuration of the developer cartridge 20 described above, the developer electrode 30 and the supplier electrode 40 may be made of conductive resin. Therefore, the developer electrode 30 and the supplier electrode 40 may be formed more easily compared to a developer electrode and a supplier electrode, which may be partly made of metal.

Although an example of carrying out the disclosure has been described, those skilled in the art will appreciate that there are numerous variations and permutations of the developer cartridge for an image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the plate part 33 may not necessarily include all of the first plate section 33A, the second incline section 33B, and the second plate section 33C, but may include the first incline section and the second plate part alone. In other words, the first incline section may be extended directly from the cover part.

For another example, the recess 30A in the developer electrode 30 may not necessarily be open to the base 60A of the bearing 60 and to the lateral wall 15 but may be formed to be open at a position closer to the lateral wall 15, i.e., may be open to the lateral wall 15, alone.

For another example, the developer electrode 30 may not necessarily be formed integrally in the conductive resin. For example, a portion of the developer electrode that ranges between a position, in which the developer electrode may contact the first electrode E1, and a position, in which the developer electrode may contact the rotation shaft 22A of the developer roller 22, may be formed in metal, and a remainder portion of the developer electrode may be formed in non-conductive resin. For another example, the developer electrode may be formed in metal alone. Analogously, the supplier electrode may be formed in resin at a portion and in non-conductive resin at another portion, or in metal alone.

What is claimed is:

1. A developer cartridge attachable to a drum cartridge including a photosensitive drum, comprising:

a casing configured to store toner therein;

a developer roller rotatable about a first axis extending in an axial direction; and a developer electrode electrically connectable with the developer roller, the developer electrode being configured to be in contact with a first electrode of an image forming apparatus along the axial direction, wherein, in a state where the developer cartridge is completely attached to the drum cartridge, a portion of the developer electrode faces an outer surface of a lateral wall of the drum cartridge that is opposite an inner surface facing the casing in a direction along the axial direction, and wherein the casing, the lateral wall of the drum cartridge and the developer electrode at least partly coincide with one another along the axial direction.

2. The developer cartridge according to claim 1, wherein the developer electrode comprises:

a cover part having a cylindrical shape, the cover part covering a circumference of a rotation shaft of the developer roller; and a plate part extending from the cover part in a radial direction of the rotation shaft, the plate part comprising a first contact section being configured to be in contact with the first electrode, wherein the plate part comprises a first incline section, the first incline section inclining to be farther apart from the casing as the plate part extends to be farther from the rotation shaft.

3. The developer cartridge according to claim 2, wherein the plate part comprises a first plate section extending from the cover part and a second plate section comprising the first contact section; and wherein the first incline section connects the first plate section and the second plate section with each other.

4. The developer cartridge according to claim 2, wherein the first contact section comprises a surface spreading orthogonally to the axial direction and being configured to be in contact with the first electrode.

5. The developer cartridge according to claim 2, wherein, in the state where the developer cartridge is attached to the drum cartridge, the plate part is spaced apart from the lateral wall of the drum cartridge along the axial direction.

6. The developer cartridge according to claim 2, wherein the casing comprises a bearing, the bearing comprising a first supporting part configured to support the rotation shaft of the developer roller, and wherein, in the state where the developer cartridge is attached to the drum cartridge, the first contact section is located at an opposite side of the lateral wall to the bearing.

7. The developer cartridge according to claim 6, further comprising:

a supplier roller rotatable about a second axis extending in the axial direction, wherein the bearing comprises a first hole, in which a first screw to fasten the developer electrode to the casing is inserted, and a second supporting part configured to support a rotation shaft of the supplier roller; and wherein the first contact section is located between the first hole and the second supporting part.

8. The developer cartridge according to claim 7, further comprising:

a supplier electrode electrically connectable with the supplier roller, the supplier electrode comprising a second contact section configured to be in contact with a second electrode of the image forming apparatus along the axial direction, wherein the second contact section is located at a position displaced from the rotation shaft of the supplier roller; and wherein the bearing comprises a second incline section arranged to adjoin the second contact section.

9. The developer cartridge according to claim 8, wherein the second incline section inclines to be farther apart from the casing as the second incline section extends to be closer to the second contact section.

10. The developer cartridge according to claim 8, wherein the bearing comprises a protector part arranged to adjoin the second contact section and extending along the second contact section.

11. The developer cartridge according to claim 7, further comprising:

a toner cap configured to close a toner supplier hole formed in the casing; and a cover configured to cover the toner cap, wherein the bearing comprises a second hole, in which a second screw to fasten the cover to the casing is inserted.

12. The developer cartridge according to claim 11, wherein the first contact section is located between the first hole and the second hole.

13. The developer cartridge according to claim 2, wherein the developer electrode is made of conductive resin.

14. The developer cartridge according to claim 2, wherein the developer electrode comprises:

a first protrusive section being in a shape of a plate extending from the cover part in the radial direction of the rotation shaft;

a second protrusive section being in a shape of a plate extending from the cover part in the radial direction of the rotation shaft; and a connector section connecting ends of the first protrusive section and the second protrusive section at a side opposite to the cover part with each other, wherein the plate part connects ends of the first protrusive section, the second protrusive section, and the connector section at a side opposite to the casing with one another, the plate part protruding from the second protrusive section in a direction to be farther from the first protrusive section.

15. A developer cartridge attachable to a drum cartridge including a photosensitive drum, comprising:

a casing configured to store toner therein;

a developer roller rotatable about an axis extending in an axial direction; and a developer electrode electrically connectable with the developer roller, the developer electrode being configured to be in contact with a first electrode of an image forming apparatus along the axial direction, wherein the developer electrode comprises a recess, in which a lateral wall of the drum cartridge is placed, in a state where the developer cartridge is attached to the drum cartridge such that a portion of the developer electrode faces an outer surface of the lateral wall that is opposite an inner surface facing the casing in a direction along the axial direction.

16. The developer cartridge according to claim 15, wherein the developer electrode comprises:

a cover part having a cylindrical shape, the cover part covering a circumference of a rotation shaft of the developer roller;

a first protrusive section being in a shape of a plate extending from the cover part in a radial direction of the rotation shaft;

a second protrusive section being in a shape of a plate extending from the cover part in the radial direction of the rotation shaft;

a connector section connecting ends of the first protrusive section and the second protrusive section at an opposite side to the cover part with each other; and a plate part connecting ends of the first protrusive section, the second protrusive section, and the connector section at a side opposite to the casing with one another, the plate part protruding from the second protrusive section in a direction to be farther from the first protrusive section; and wherein the recess is formed by the plate part and the second protrusive section.

17. The developer cartridge according to claim 16, wherein the developer electrode comprises a fastening section, the fastening section protruding from the first protrusive section in a direction to be farther from the second protrusive section, the fastening section comprising a hole, in which a screw to fasten the developer electrode to the casing is inserted.

18. The developer cartridge according to claim 16, wherein the plate part comprises an incline section, the incline section inclining to be farther from the casing as the incline section extending farther from the cover part.

19. The developer cartridge according to claim 18, wherein an end of the incline section at a side opposite to the first protrusive part is located at a position farther apart than the second protrusive section from the first protrusive section.

* * * * *